US010575105B2

(12) United States Patent
Meister et al.

(10) Patent No.: US 10,575,105 B2
(45) Date of Patent: Feb. 25, 2020

(54) METHOD FOR CHARACTERIZING A RECEIVER IN A HEARING DEVICE, HEARING DEVICE AND TEST APPARATUS FOR A HEARING DEVICE

(71) Applicant: SIVANTOS PTE. LTD., Singapore (SG)

(72) Inventors: Bernd Meister, Erlangen (DE); Tom Maennel, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/976,924

(22) Filed: May 11, 2018

(65) Prior Publication Data

US 2018/0359573 A1 Dec. 13, 2018

(30) Foreign Application Priority Data

Jun. 9, 2017 (DE) ..... 10 2017 209 816

(51) Int. Cl.
*H04R 25/00* (2006.01)

(52) U.S. Cl.
CPC ..... *H04R 25/505* (2013.01); *H04R 2225/025* (2013.01); *H04R 2225/31* (2013.01); *H04R 2225/41* (2013.01); *H04R 2225/43* (2013.01)

(58) Field of Classification Search
None
See application file for complete search history.

(56) References Cited

U.S. PATENT DOCUMENTS

| | | | | |
|---|---|---|---|---|
| 6,603,860 | B1 | 8/2003 | Taenzer et al. | |
| 7,082,205 | B1 | 7/2006 | Westermann | |
| 7,447,319 | B2 * | 11/2008 | Miller | H04R 25/30 381/60 |
| 9,648,410 | B1 | 5/2017 | Kratsas et al. | |
| 9,992,582 | B2 | 6/2018 | Jensen et al. | |
| 2003/0163021 | A1 | 8/2003 | Miller et al. | |
| 2004/0052391 | A1 * | 3/2004 | Bren | H04R 25/43 381/331 |
| 2007/0286441 | A1 | 12/2007 | Harsch et al. | |
| 2009/0052707 | A1 * | 2/2009 | Hain | H04R 25/43 381/315 |
| 2012/0294468 | A1 | 11/2012 | Sacha | |
| 2013/0343585 | A1 | 12/2013 | Bennett et al. | |
| 2015/0281851 | A1 * | 10/2015 | Tzeng | H04R 25/558 381/312 |
| 2017/0223468 | A1 * | 8/2017 | Jensen | H04R 25/305 |

(Continued)

FOREIGN PATENT DOCUMENTS

| | | | |
|---|---|---|---|
| EP | 3226577 | A1 | 10/2017 |
| JP | 2002530033 | A | 9/2002 |

(Continued)

*Primary Examiner* — Quoc D Tran
(74) *Attorney, Agent, or Firm* — Laurence A. Greenberg; Werner H. Stemer; Ralph E. Locher

(57) ABSTRACT

A method for characterizing a receiver in a hearing device. The receiver has a response behavior. The receiver converts an electrical audio signal into a sound signal, generating a magnetic field. The magnetic field is measured by a magnetic field sensor. The receiver is then characterized by determining the response behavior of the receiver based on the measured magnetic field. There is also described a hearing device and a test apparatus for a hearing device.

17 Claims, 2 Drawing Sheets

(56) References Cited

U.S. PATENT DOCUMENTS

| | | | | |
|---|---|---|---|---|
| 2017/0289671 | A1* | 10/2017 | Patel | H04R 1/1041 |
| 2017/0374448 | A1* | 12/2017 | Patel | H04R 1/1041 |

FOREIGN PATENT DOCUMENTS

| | | | |
|---|---|---|---|
| JP | 2016100793 | A | 5/2016 |
| WO | 9719573 | A1 | 5/1997 |
| WO | 2016058637 | A1 | 4/2016 |

* cited by examiner

METHOD FOR CHARACTERIZING A RECEIVER IN A HEARING DEVICE, HEARING DEVICE AND TEST APPARATUS FOR A HEARING DEVICE

CROSS-REFERENCE TO RELATED APPLICATION

This application claims the priority, under 35 U.S.C. § 119, of German patent application DE 10 2017 209 816.3, filed Jun. 9, 2017; the prior application is herewith incorporated by reference in its entirety.

BACKGROUND OF THE INVENTION

Field of the Invention

The invention relates to a method for characterizing a receiver in a hearing device, wherein the receiver is embedded in an environment and has a response behavior that is influenced by the environment. The invention further relates to a hearing device and a test apparatus for a hearing device.

Hearing devices are used to aid users who, typically, are hearing impaired. To this end, the hearing device has a microphone for recording sound signals in the environment and for converting these sound signals into electrical audio signals. These electrical audio signals are processed via a control unit, typically are amplified, and are forwarded to a receiver, which converts the processed electrical audio signals into sound signals and outputs these sound signals to the user. The receiver accordingly uses a magnetic field to convert the electricity into motion. The receiver is therefore also referred to as an electro-acoustic transducer. Depending on the type of hearing device, the receiver sits in or on the user's ear. In a BTE device (behind-the-ear), which is worn behind the ear, the receiver sits in a housing of the hearing device, and the sound signals are routed from the receiver to the ear via a sound tube. In an RIC (receiver-in-canal) device, in contrast, the receiver is inserted into the ear, for example by means of an earmold, but the remainder of the hearing device is worn predominantly outside the ear. An ITE (in-the-ear) device is fully inserted into the ear. Examples of ITE devices are ITC (in-the-canal) and CIC (completely-in-canal) devices, which are worn in the ear canal or completely in the ear canal.

In the course of preparing the electrical audio signals with the hearing device, a certain output characteristic, or in simple terms an output, may be achieved, which is tailored to the user's hearing ability. The output characteristic indicates in particular how exactly an incoming sound signal is modified in order to obtain an outgoing sound signal having a specific output power, or simply "power" for short, or power characteristic, which is then output to the user. For example, only certain frequency ranges should be amplified, while other frequency ranges should not. To this end, an audiogram is typically created, on the basis of which the hearing device is then appropriately adjusted in a fitting session to achieve the desired output and to ensure optimal treatment. Thus, the control unit must be configured to modify the electrical audio signals in precisely such a way as to achieve the desired output. The problem with this is that the receiver, being an additional member between the control unit and the user's ear, causes a further change, which must accordingly be accounted for. The receiver provides an additional transfer function along the signal path from the environment, to the microphone, to the control unit, to the receiver, and finally to the user's ear. This transfer function defines the receiver's response behavior, i.e. how the receiver converts a given audio signal into a sound signal. Further changes and transfer functions along the signal path arise in particular from the individual dimensioning of the sound tube, a degree of soiling of an ear piece, e.g. an earmold, or the specific configuration of the ear piece, or a combination thereof.

Initially, the response behavior is logically dependent on the audio signal. Typically, an increase in the amplitude of the audio signal also leads to a louder sound signal. This dependence on the audio signal is primarily used in hearing devices to achieve a certain output by shaping the audio signal with the control unit. But the receiver's response behavior is typically also dependent on the receiver's specific installation and/or usage situation; thus, an individual characterization of the response behavior is desirable.

SUMMARY OF THE INVENTION

It is accordingly an object of the invention to provide a method which overcomes a variety of disadvantages associated with the heretofore-known devices and methods of this general type and which provide for a method that characterizes a hearing device as individually as possible. The process should be as simple as possible and as accurate as possible. Furthermore, it is an object of the invention to provide a hearing device and a test apparatus that are suitable for carrying out the method.

With the foregoing and other objects in view there is provided, in accordance with the invention, a method for characterizing a receiver of a hearing device, wherein the receiver is embedded in an environment and exhibits a response behavior that is influenced by the environment. The method comprises:

converting with the receiver an electrical audio signal into a sound signal and thereby generating a magnetic field;

measuring the magnetic field with a magnetic field sensor; and characterizing the receiver by determining the response behavior of the receiver based on the magnetic field measured by the magnetic field sensor.

The method is used to characterize a receiver in a hearing device. In other words, the method is used to characterize a receiver that is built into a hearing device. The receiver is thus a component of the hearing device. The characterization also takes place in particular with the receiver in an installed state. Thus, the receiver is preferably not removed for characterization. The receiver is used to convert electrical audio signals into sound signals and to output these sound signals to a user of the hearing device. The electrical audio signals are also referred to as audio signals.

With the above and other objects in view there is also provided, in accordance with the invention, a hearing device and a test arrangement with the necessary components and with a control unit that is configured to measure the magnetic field by way of the magnetic field sensor and to characterize the receiver by determining the response behavior of the receiver based on the magnetic field measured by said magnetic field sensor.

The hearing device is preferably a hearing device that serves to supply a user, particularly a hearing-impaired user, with amplified sound signals. Such a hearing device is also called a hearing aid. To this end, the hearing device has a microphone for receiving a sound signal from the environment and for converting this sound signal into an electrical audio signal. Alternatively, or preferably in addition, the hearing device has a data connection, whereby an electrical audio signal is transmitted from an external source to the hearing device. The external source is e.g. a telephone, television, music system, or the like. The data connection is, for example, a Bluetooth receiver for receiving signals from an external source's Bluetooth transmitter. The electrical audio signal is processed by means of a control unit, is typically amplified, but at least modified, and is forwarded to the receiver, which converts the processed audio signal back into a sound signal and outputs it to the user.

However, the invention is in principle not limited to such hearing aids. Rather, in a variant, the method is advantageously used for characterizing a receiver in a hearing device, which is generally designed for the output of sound signals, and thus does not necessarily have a microphone and also is not necessarily used to treat a hearing-impaired user. In this context, the receiver is also called a speaker. The hearing device is, in this case, generally a hearing system which serves at least for sound output, and in which the receiver's response behavior is potentially at risk of being influenced by its environment. For example, the hearing device is a headphone or a smartphone or generally a communication device, in particular a mobile communication device or a "hearable." Even with hearing devices of this kind, there is for example a risk that the receiver may be clogged, and that the response behavior may be changed as a result. Such a hearing device also advantageously has a control unit as described hereinabove and hereinbelow.

The receiver has a specific response behavior. The response behavior is defined in particular by the ratio of the audio signal, which is an input signal of the receiver, to the sound signal, which is an output signal of the receiver. More specifically, the response behavior is defined by the ratio of the powers of the input signal and the output signal. The response behavior thus indicates what output power the receiver has for a given input power. The response behavior is particularly frequency-dependent; in other words, audio signals of the same strength but different frequencies may, depending on the circumstances, be converted into sound signals of different strengths.

In the context of the method, the receiver converts an electrical audio signal, also referred to simply as an audio signal or electrical signal, into a sound signal, i.e. an acoustic signal. A magnetic field is then generated. This results in particular from the general mode of operation of the receiver, according to which the electrical signal is used to drive a movable component which then generates pressure fluctuations. The receiver accordingly uses a magnetic field to convert electricity into motion. Because the electrical signal represents an alternating electric field, in other words a time-varying current, a magnetic field is also generated. The strength of this magnetic field is dependent on the magnitude of the change in current, and this in turn depends on the load of the receiver.

The generated magnetic field is measured by means of a magnetic field sensor. The magnetic field sensor then outputs a measurement signal. The measurement signal is for example a voltage which is proportional to the magnetic field, or more precisely, is proportional to the strength of the magnetic field. Alternatively, the measurement signal is a digital measurement signal. In one variant, the measurement signal is not proportional to the magnetic field, and in particular is a preprocessed measurement signal. Basically any sensor designed to measure a magnetic field and to output a corresponding measurement signal is suitable for the magnetic field sensor, for example, a Hall sensor or a simple conductor loop.

The receiver is now characterized by determining the receiver's response behavior based on the measured magnetic field. Put differently: the receiver's response behavior is determined on the basis of the magnetic field, or more precisely, on the basis of the measurement signal of the magnetic field sensor. Thus, the receiver is characterized by measuring a magnetic field which is generated in the course of the receiver's operation.

Because the receiver's response behavior depends on its specific installation and/or usage situation, the receiver is characterized in isolation as a single part, but rather is comprehensively characterized in its specific installation and/or usage situation. In this specific installation and/or usage situation, the receiver's response behavior is influenced by its particularly immediate environment. Put differently: the receiver is embedded in an environment in which a number of elements are arranged, which in particular are mechanically connected or coupled to the receiver and thereby influence the operation of the receiver. This also influences the receiver's response behavior accordingly. The environment of the receiver is also referred to as the receiver environment.

The elements of the environment are typically other parts of the hearing device, such as a sound tube, an earmold, a dome or a housing of the hearing device. The receiver is in particular a component of a complex of parts, in which the receiver is connected to a number of other parts of the hearing device. However, the elements of the environment do not necessarily have to be parts of the hearing device; alternatively or in addition, they may be, for example, the user's auditory canal or earwax which has accumulated in the environment of the receiver. Such elements also influence the receiver's response behavior. It is thus common to all elements that they are coupled to the receiver in such a way that they influence the receiver's response behavior. A receiver that is influenced in this way, and is embedded in a corresponding environment, is also referred to as a receiver with coupling. The coupling substantially determines the change in the response behavior.

The characterization of the receiver is thus in particular a characterization of the receiver together with its coupling, i.e. the receiver, which is embedded in a specific environment that influences its response behavior. Accordingly, the method more specifically serves to characterize the response behavior of a receiver that is embedded in an environment that contains a number of elements that influence the receiver's response. As already mentioned, this does not necessarily mean an isolated characterization of the receiver alone, but rather a characterization of the receiver, particularly as a part of the hearing device, i.e. in a specific installation situation, or in a specific usage situation, or both. As a result, the method serves to individually characterize the receiver and to individually characterize of the response behavior of a receiver in a specific installation and/or usage situation.

It is clear from the foregoing that the response behavior may not be derived directly from the measurement signal itself. Therefore, the response behavior is advantageously determined by the response behavior being suggested based on the measurement signal, using a suitable model of, in particular, an acoustic coupling of the environment to the receiver. The model is in particular an electro-magneto-mechano-acoustic model. The model advantageously is based on an environment that is generally already known, i.e. which type of hearing device is involved and how the hearing device in general and receiver in particular are worn.

On the basis of the model, a control unit then selects suitable algorithms in order to suggest the response behavior based on the measurement signal.

The invention initially arose from the observation that the response behavior of a receiver, in addition to depending on the input signal, generally also depends on the specific environment in which the receiver is located. Especially in the case of a hearing device, the response behavior is typically initially dependent on the installation situation, i.e. how and where the receiver is mounted in the hearing device and which other parts the receiver is connected to. In particular, in the case of a sound tube which is connected to the receiver for transmitting sound into the ear, the nature and length of the sound tube, which is often individually adapted, determine the response behavior. Furthermore, the response behavior is typically also dependent how a specific user uses the hearing device, in particular on the individual wearing style and the likewise individual degree of coupling between the receiver and the user's ear; in other words, the response behavior depends on the specific usage situation. In addition, the response behavior is also time-dependent in that the environment and the installation and/or usage situation may change over time, for example, as a result of a progressive obstruction of the receiver with earwax, or replacement of the sound tube. Overall, the response behavior is therefore dependent on a variety of particular individual factors, which may be unknown when the receiver is produced and/or when the entire hearing device is designed and manufactured, or which may change over time, or even both.

An important advantage of the invention consists particularly in the fact that by means of measuring the magnetic field, corresponding changes in response behavior may be detected particularly accurately in a simple way. In particular, those individual or time-dependent changes which are not considered or cannot be considered in the production of the hearing device or in the context of a fitting session, are advantageously recognized. One such change, for example, is a progressive clogging with earwax or a replacement or modification of a sound tube or earmold or dome of the hearing device. An essential aspect of this is in particular that the receiver's response behavior is not directly or at least not exclusively isolated and determined in an ideal state. Rather, the response behavior is advantageously determined in a particular installation or use situation, or both. As a result, those changes that arise from the installation and/or usage situation relative to a reference situation such as an ideal state are captured and preferably also monitored, in particular recurrently monitored.

The method is based in particular on the knowledge that the magnetic field generated by the receiver also reflects the receiver's response behavior, because the response behavior is significantly defined by the output power, and this power and the magnetic field are each directly dependent on the current fed to the receiver. The magnetic field may thus profitably be used to determine this exact response behavior, and it is also used in this way in the context of this invention.

In principle, the response behaviors may be determined by this means, and the receiver may be characterized by using, for example, a test signal having a known strength as the audio signal, and measuring the strength of the sound signal generated therefrom. This is done for example via an impedance measurement, which ultimately measures the current via the receiver and thus measures the output power, i.e. the strength of the sound signal. The relationship in this case is dictated by a particular model, knowledge of which makes it possible to deduce a result based on the impedance measurement. The frequency-dependent response behavior is then performed in accordance with multiple test signals of differing frequency. Other measuring methods and test methods are also possible. As an alternative to such an impedance measurement, a vibration measurement may also be performed. A magnetic field measurement has the particular advantage that such a measurement is significantly more accurate than an impedance or vibration measurement. The magnetic field itself is disturbed to a particularly small extent by the environment, while an impedance or a vibration measurement is subjected to severe errors by additional electrical or mechanical connections with other parts or components. In a magnetic field measurement, a measurement signal is also generated with a particularly large amplitude, whereby even the smallest changes are still reliably detected and thus the response behavior may accordingly be determined with particularly high accuracy.

In a preferred embodiment, the environment is determined by an installation situation of the receiver, and the environment has an element which is a part of the hearing device. The part is connected to the receiver and in particular is mechanically coupled to the receiver and influences its response behavior. The influence of the installation situation on the response behavior is advantageously automatically taken into account in determining the response behavior. This element, more specifically this part, is preferably selected from a set of elements including but not limited to: a sound tube, an earmold, a dome, and a housing of the hearing device.

Alternatively or in addition, the environment is preferably determined by a usage situation of the receiver. The influence of the usage situation on the response behavior is advantageously automatically taken into account in determining the response behavior. Here, the usage situation is selected from a set of situations, comprising but not limited to: a wearing style of the hearing device, a degree of coupling between the receiver and the user's ear, a degree of clogging, especially clogging of the receiver by earwax. Similar to the installation situation described above, in the usage situation, the environment also contains a number of elements, which in particular are mechanically coupled to the receiver and thereby influence the response behavior. However, these elements are not components of the hearing device, but external elements, particularly the auditory canal of the user, the user's ear, or earwax.

Knowledge of the response behavior advantageously allows a reaction to a change therein. To this end, the response behavior is advantageously determined, and this actual response behavior is compared with a desired response behavior. A difference is then determined between the actual response behavior and the desired response behavior, and the hearing device is adjusted based on the difference. By "adjusted" is meant in particular that the hearing device is controlled in such a way that the receiver's response behavior is changed in order to reduce this difference, and preferably to completely eliminate it. In this case, the response behavior is preferably adapted to the desired response behavior, and particularly preferably is adapted in such a way that the response behavior matches the desired response behavior.

In an expedient embodiment, the hearing device is adjusted by the audio signal being modified via the control unit in such a way that the difference is at least partially, and preferably completely, compensated. In this way, in particular, an approximation of the response behavior to the desired response behavior is achieved.

Alternatively or in addition, knowledge of the response behavior is used to output a warning signal. To this end, the response behavior is likewise advantageously determined, and this actual response behavior is compared with a desired response behavior. A difference is determined between the actual response behavior and the desired response behavior, and a warning signal is output depending on the difference. Put differently: if there is a difference, or if there is a difference greater than a predefined threshold value, a warning signal is output. The warning signal is for example output acoustically via the receiver, transmitted optically by means of an LED or to a remote control or base station for the hearing device, in particular for output or storage at that location.

Particularly useful is the embodiment having the warning signal to, upon a certain degree of clogging of the receiver with earwax, indicate that clogging exactly, and thereby advantageously cause the user to clean the receiver. The embodiment with a warning indication is used alternatively or in addition to detect whether a specific sound tube has been mounted on the hearing device and, if a different sound tube has been mounted, to indicate that the wrong sound tube has been mounted or that an adaptation of the response behavior is necessary.

Alternatively or in addition, it is detected whether the receiver has a defect. A defect is in particular a distortion in the output of a sound signal due to a mechanical defect, e.g. as a result of an impact or a fall. A distortion of this kind is also referred to as a total harmonic distortion (acronym: THD). Alternatively, the defect is a failure or breakage of an electrical line. Alternatively, the defect is a jamming of several parts, in particular internal parts, i.e. components of the receiver.

The desired response behavior is advantageously determined by means of a calibration measurement. The calibration measurement preferably takes place in a state in which an ideal response behavior exists, for example in the context of a first initialization during production, in particular because the acoustic coupling of the receiver is known at this point in time, and a number of model parameters of the receiver are extracted and preferably also stored. In particular, the model parameters indicate the coupling. Alternatively or in addition, the calibration measurement takes place in the context of a fitting session or directly thereafter, or after a cleaning of the hearing device, or directly after a new sound tube or a new earmold has been mounted. Alternatively or in addition, the calibration measurement takes place during or at the end of the production of the hearing device and before it is delivered to the user. This is based in particular on the consideration of using a delivery state of the hearing device as a basis for comparison for later changes in the response behavior. This is advantageous, for example, in detecting damage or malfunction of the receiver.

In an advantageous development, a plurality of desired response behaviors are determined, for example for different environments in which the hearing device is worn, for different users of the hearing device, for different operating modes of the hearing device, for different sound tubes, or for different ear molds or for a combination thereof. Depending on the specific situation, a suitable desired response behavior is then selected, with which the measured response behavior is compared.

In a suitable embodiment, the desired response behavior is determined in the calibration measurement in the same way as the response behavior in general, i.e., in this case, by measuring the magnetic field. Accordingly, an initial magnetic field measurement is carried out.

Particularly preferred is an embodiment in which the response behavior, i.e. the transfer function of the receiver, is parameterized by means of an adaptive filter, by measuring the magnetic field and generating a measurement signal based thereon, which is fed to the filter as a filter input signal. The measurement signal is generated by the magnetic field sensor and is for example a voltage. In a suitable embodiment, the filter is a Wiener filter. The filter has a filter function which is parameterized by a number of filter parameters. The measurement signal is then fed to the filter as a filter input signal, whereupon the filter automatically adapts the filter function to the filter input signal, in order to map this signal. The filter parameters are then changed accordingly.

In particular, the filter operates autonomously, automatically carrying out the adaptation and modification of the filter parameters, and does not require a separate external adjustment. The filter parameters thus change when the magnetic field changes, i.e. also with a change of the response behavior, so that the response behavior is advantageously parameterized, and also determined, by the filter parameters. Thus, instead of measuring the response behavior in detail, only the filter parameters are used to determine the response behavior. The use of an adaptive filter has the special advantage that such a filter adapts very quickly to changes, and as a result, changes in the response behavior are recognized and determined particularly quickly. Adaptation of the response behavior is not necessarily a purpose of the filter, i.e. the filter does not necessarily adjust the response behavior; rather, the filter serves primarily and in particular exclusively to parameterize the response behavior, by following this response behavior.

The magnetic field, or more precisely the strength thereof, falls with increasing distance from the hearing device. Therefore, the magnetic field is advantageously measured as close as possible to, or in, the hearing device; in other words, the magnetic field sensor is arranged as close as possible to or in the hearing device. In the specific case of a hearing device, the magnetic field may be measured particularly well near the hearing device within a distance that is on the order of magnitude of a dimension of the hearing device. Conventional hearing devices have a size of about 0.5 to 5 cm; accordingly, the magnetic field may be measured particularly effectively at a distance of up to a few centimeters, and is therefore also preferably measured in this range.

In a preferred embodiment, the magnetic field sensor is arranged directly on the receiver, i.e. in particular at a distance from the receiver of at most 3 cm, preferably at most 5 mm, and particularly preferably directly on or even in the receiver. The magnetic field is thus measured directly at the receiver where the magnetic field is particularly strong, so that the measurement is correspondingly accurate.

In a suitable variant, the hearing device has a power supply, in particular a battery, which is connected to the receiver by means of a power supply line, for supplying power to the receiver, and the magnetic field sensor is arranged directly at the power supply line, i.e. in particular at a distance of at most 3 cm, preferably at most 5 mm, from the power supply line, and particularly preferably directly on or even in the power supply line. The aforementioned parameters are particularly suitable for a hearing device which is designed as a hearing aid for a hearing-impaired user. Larger values are also suitable for other hearing devices, in particular if the power supply is stronger, i.e. provides more power, than in a hearing aid. The magnetic field is thus measured directly at the power supply line. This embodiment is based, in particular, on the knowledge that the receiver generates an alternating load during operation and thus draws a time-varying current from the power supply, which in turn generates a magnetic field. The receiver thus generates a magnetic field not only in its immediate vicinity, but also along the power supply line, which extends from the power supply to the receiver, and also at the power supply. The magnetic field is therefore advantageously measured on the power supply line or at the power supply itself. A magnetic field measurement near the power supply line or the power supply is advantageous in that these parts are typically located outside the user's ear. Especially in a hearing device in which the receiver is worn inside the ear, the space around the receiver is of course severely limited, so that an additional magnetic field sensor cannot be realized on the receiver. Especially in such cases, the magnetic field is then measured elsewhere outside the ear, preferably as described near the power supply line or power supply. Due to further parts of the hearing device, which are connected to the power supply, a measurement on the power supply itself may be too inaccurate, which is why a magnetic field measurement on the power supply line is preferred. The power supply line serves in particular solely to supply the receiver, i.e. no other parts or users are connected to the power supply via the power supply line. In this way it is ensured that the measured magnetic field is predominantly, and in particular solely, caused by the operation of the receiver.

In principle, however, a measurement of the magnetic field elsewhere is possible and may also be appropriate. However, the above two variants represent particularly suitable measurement locations, and are accordingly preferred.

In accordance with a first preferred embodiment of the invention, the magnetic field sensor is integrated into the hearing device, i.e. it is a component of the hearing device. Overall, the hearing device thus has a receiver for converting an electrical audio signal into a sound signal, generating a magnetic field, and a magnetic field sensor, and additionally a control unit, designed in such a way that the magnetic field is measured by means of the magnetic field sensor, and the receiver is characterized by determining the response behavior based on the measured magnetic field. In this embodiment, the hearing device in particular automatically determines the receiver's response behavior, preferably continuously; but alternatively, for example, only in a test mode. The hearing device advantageously adjusts itself automatically based on the response behavior, in particular in order to set a specific desired response behavior, as already described above. Advantageously, the user is informed about the measurement or how the hearing device adjusts based on the same, or both. The user is informed, for example, by means of a warning signal as described above.

In particular, in the case of a magnetic field sensor integrated into the hearing device, the method is preferably carried out in a normal operating mode of the hearing device, i.e., in particular, not during a fitting session or during the production of the hearing device. Instead, the characterization takes place during normal operation, while the hearing device is being worn or used by the user. In the normal operation mode, an electrical audio signal is modified by means of a control unit and is then output by the receiver as a sound signal. The electrical audio signal itself is generated in particular by means of a microphone, which converts a sound signal from the environment into the audio signal. Alternatively, the audio signal is supplied from an external source. An external source may be, for example, a streaming signal, for example in a wireless system.

In a particularly suitable embodiment, the hearing device has a telecoil which forms the magnetic field sensor. That is, the telecoil is used as a magnetic field sensor. Put differently: the hearing device has a telecoil which is placed or arranged in such a way that it may be, and also is, used as a magnetic field sensor. In particular, accurately positioning the telecoil is important in order to measure the magnetic field as effectively as possible. The telecoil is also called a telephone coil or T-Coil. This is based on the consideration that the telecoil is of course already designed for measuring magnetic fields and therefore may also profitably be used for measuring the magnetic field generated by the receiver described herein. This reduces the design effort considerably, because a telecoil is already a standard part of many hearing devices. A magnetic field sensor as an additional part is advantageously eliminated; instead, the existing hardware, namely the telecoil, is used. The telecoil is a coil, e.g. a conductor loop, which receives signals by induction. A transmitter, e.g. a telephone with an electrodynamically operating transducer or an inductive hearing device, emits an alternating magnetic field which is received by the telecoil and which is then converted in particular into an audio signal. This is also advantageously interference-free compared to the recording by means of microphone, because noise is typically not transmitted. By "interference-free" is meant in particular "largely interference-free." By "interference-free" is further understood in particular that the telecoil in these frequency ranges, which are relevant for magnetic field measurement, is interference-free, while, for example, the mains voltage at 50 Hz and the harmonics thereof may, depending on the circumstances, be detected by the telecoil. The telecoil is also already arranged in particular at a suitable proximity to the receiver.

But the concept of magnetic field measurement is advantageously not limited to a hearing device with an integrated magnetic field sensor. In a second preferred embodiment, the magnetic field sensor is part of a test arrangement for a hearing device. The test arrangement has a control unit and a test apparatus, which has a magnetic field sensor. The test arrangement is designed for testing a hearing device, more precisely for characterizing a receiver of the hearing device. The hearing device accordingly has a receiver for converting an electrical audio signal into a sound signal, generating a magnetic field. The control unit is designed in such a way that the magnetic field is measured by means of the magnetic field sensor; and the receiver is characterized by determining the receiver's response behavior based on the measured magnetic field.

The magnetic field sensor is thus arranged outside the hearing device, namely in or on the test apparatus, which together with the control unit makes up the test arrangement. In a suitable first variant, the magnetic field sensor and the control unit are each part of a test apparatus, i.e. the test apparatus is identical to the test arrangement. In a likewise suitable second variant, in contrast, the magnetic field sensor and the control unit are arranged separately from one another. The magnetic field sensor is then a part of a test apparatus, while the control unit is not. In this case the control unit is, for example, a control unit of the hearing device or a control unit of an additional external device.

The measurement itself does not differ fundamentally from the measurement with a magnetic field sensor in the hearing device. To characterize the receiver, the hearing device is brought into the vicinity of the test arrangement, more precisely the test apparatus, and then a magnetic field measurement is begun. Such a test arrangement is also particularly suitable for use by an audiologist, for example in the context of a fitting session.

Examples of a test apparatus which is identical to the test arrangement are a charging station or base station for the hearing device, or a remote control. Very particularly advantageous is the use of a smartphone as a test apparatus, which is advantageously equipped with appropriate software to carry out the magnetic field measurement and the determination of the response behavior.

An embodiment is preferred in which the test apparatus is an audio shoe which is connected to the hearing device in particular as an additional sensor. The audio shoe may be placed on the hearing device, more precisely on the housing, and may be worn by the user together with the hearing device. The test apparatus in this case is set up as an adapter. In an advantageous embodiment, the test apparatus is set up as an independent module and has a wireless system for communicating with the hearing device.

Also particularly suitable is an embodiment wherein the test apparatus is a telecoil shoe, which may be placed on the hearing device as an adapter, and wherein the magnetic field sensor is a telecoil—particularly a telecoil as described above—which is arranged inside the telecoil shoe. The control unit is in this case preferably arranged outside the telecoil shoe, and therefore is not a part thereof. Preferably, the control unit is a control unit of the hearing device. The telecoil shoe is set up as an adapter, similar to the audio shoe described above, and subsequently equips the hearing device with a telecoil. The telecoil shoe is worn by the user, in particular during normal operation of the hearing device.

Other features which are considered as characteristic for the invention are set forth in the appended claims.

Although the invention is illustrated and described herein as embodied in method for characterizing a receiver in a hearing device, hearing device and test apparatus for a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DETAILED DESCRIPTION OF THE INVENTION

Figure 1:
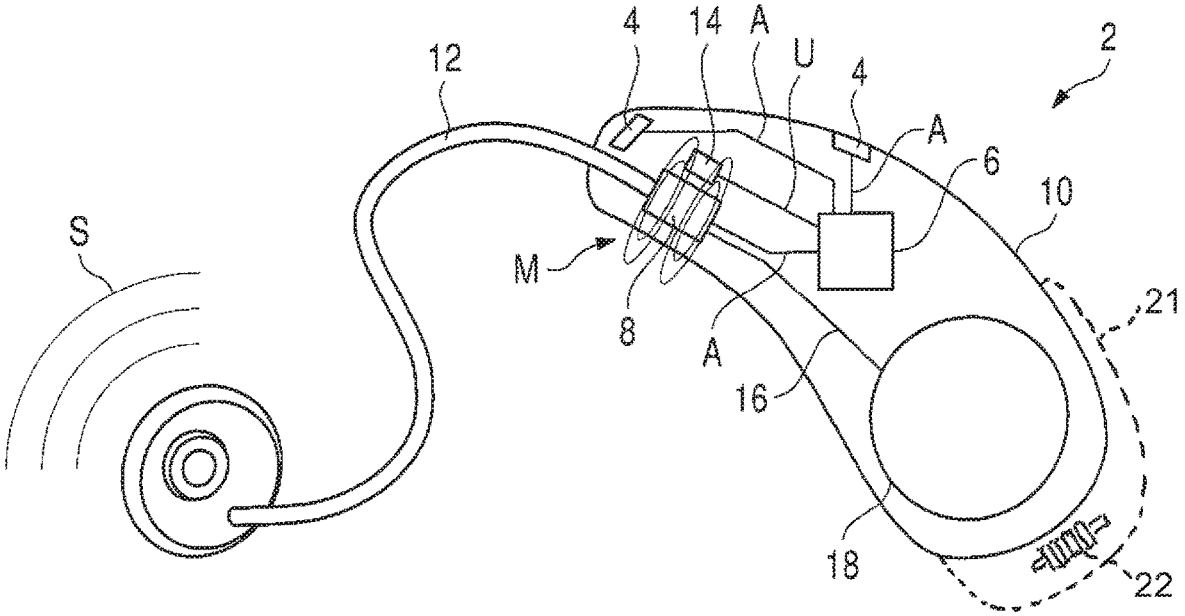
FIG. 1 is a diagrammatic illustration of a hearing device with an integrated magnetic field sensor.

Referring now to the figures of the drawing in detail and first, particularly, to FIG. 1 thereof, there is shown a hearing device 2, which is used for aiding a hearing-impaired user. The hearing device 2 has a number of microphones 4, in this case two, whereby sound signals from the environment are acquired and converted into electrical audio signals A. The audio signals A are forwarded to a control unit 6 and are modified there—typically amplified—according to the user's needs. The modified audio signals A are forwarded by the control unit 6 to a receiver 8, which converts the audio signals A back into sound signals S and outputs them.

The hearing device 2 is in this case a BTE hearing device, with a housing 10, which the user wears behind the ear, and with a sound tube 12, which directs the sound signals S from the receiver 8 to the ear. Alternatively, the hearing device 2 is a RIC hearing device, in which the housing 10 is also worn behind the ear, but the receiver 8 is inserted into the ear; the sound tube 12 is then replaced by a cable. In a further alternative, the hearing device 2 is an ITE hearing device which is fully inserted into the ear. Further alternative embodiments for the hearing device 2 are also suitable.

In the operation of the receiver 8, i.e. in the conversion of an audio signal A into a sound signal S, a magnetic field M is generated, which is shown only roughly in FIG. 1 for purposes of visualization. The magnetic field M results from the general mode of operation of the receiver 8, during the operation whereof a time-varying alternating electric field arises, which corresponds to a time-varying current, which in turn generates the magnetic field M. The generated magnetic field M is measured by a magnetic field sensor 14. This sensor then outputs a measurement signal U, U', for example, a voltage proportional to the magnetic field M. On the basis of the measured magnetic field M, that is to say by means of the measurement signal U, a response V, V' of the receiver 8 is determined and the receiver is characterized thereby, or a warning signal is output, or both. For this purpose, the measurement signal U, U' is evaluated, for example by the control unit 6.

In the embodiment of FIG. 1, the magnetic field M near the receiver 8 is measured. This is not necessary, however. Because each alternating electric field naturally also generates a magnetic field M, a corresponding magnetic field M is also generated along a power supply line 16 and in the vicinity of a power supply 18. An explicit depiction of this effect in FIG. 1 has been omitted, for the sake of simplicity. In FIG. 1, the power supply 18 is a battery. This battery is connected to the receiver 8 via the power supply line 16, in order to provide the receiver 8 with energy. Instead of arranging the magnetic field sensor 14 near the receiver 8, in a non-illustrated alternative embodiment, the magnetic field sensor 14 is arranged near the power supply line 16.

In FIG. 1, by way of example, the magnetic field sensor 14 is a Hall sensor or a simple conductor loop. In an alternative, a telecoil is used as the magnetic field sensor 14, and is integrated into the hearing device 2.

Figure 2:
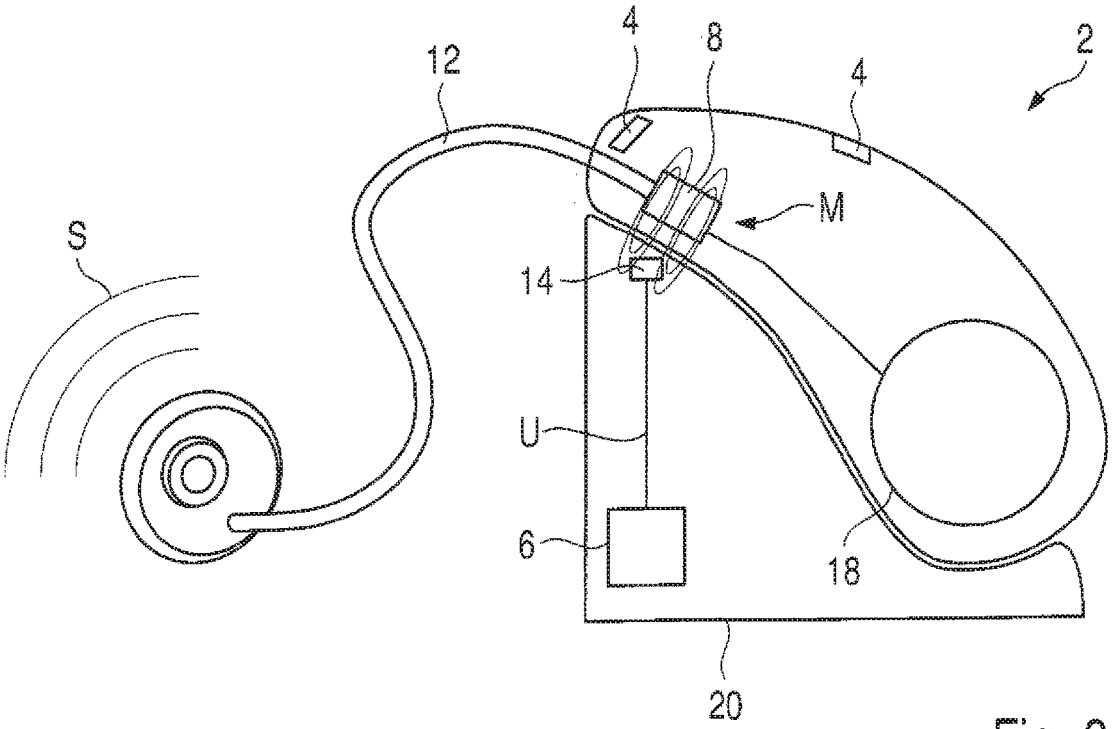
FIG. 2 is a diagrammatic view of a test apparatus with a magnetic field sensor and a hearing device.

In FIG. 1, the magnetic field sensor 14 is integrated into the hearing device 2. However, the underlying measurement principle does not require this. FIG. 2 accordingly shows a variant wherein the magnetic field sensor 14 is arranged outside the hearing device 2, namely in a test apparatus 20, which here is a charging station or base station for the hearing device 2 and also makes up a test arrangement for the hearing device 2. The test apparatus 20 has a control unit 6, to which the magnetic field sensor 14 is connected. The measurement itself does not differ fundamentally from measurement with a magnetic field sensor 14 inside the hearing device 2. To characterize the receiver 8, the hearing device 2 is brought near the test apparatus 20, e.g. is inserted as shown in FIG. 2, and a sound signal S is output via the receiver 8, and magnetic field measurement is then begun.

A further alternative is illustrated by the dashed lines in FIG. 1. There, the test apparatus is a telecoil shoe 21, which may be placed on the hearing device as an adapter, and wherein the magnetic field sensor is a telecoil 22, particularly a telecoil as described above, which is arranged inside the telecoil shoe. The control unit is in this case preferably arranged outside the telecoil shoe, and therefore is not a part thereof. Preferably, the control unit is a control unit of the hearing device. The telecoil shoe is set up as an adapter, similar to the audio shoe described above, and subsequently equips the hearing device with a telecoil. The telecoil shoe is worn by the user, in particular during normal operation of the hearing device.

The characterization of the receiver 8 is based on the knowledge that the magnetic field M generated by the receiver 8 also reflects the response behavior V, V' of the receiver 8. The response behavior V, V' is substantially defined by the output power, and this power and the magnetic field M are each directly dependent on the current fed to the receiver 8. In addition to depending on the audio signal A, the response behavior V, V' is also dependent on the specific environment in which the receiver 8 is located, and is especially dependent on the installation situation, i.e., how and where the receiver 8 is mounted inside the hearing device 2 and which other components are connected to the receiver 8. For example, the type and length of the sound tube 12 determine the response behavior V, V'. Furthermore, the response behavior V, V' also depends on how a specific user uses the hearing device 2, in particular on the individual wearing style and the likewise individual degree of coupling between the receiver 2 and the user's ear. In addition, the response behavior V, V' is also time-dependent in that the environment and the installation situation may change over time, for example, through progressive obstruction of the receiver 8 or sound tube 12 with earwax or replacement of the sound tube 12, or other effects.

Figure 3:
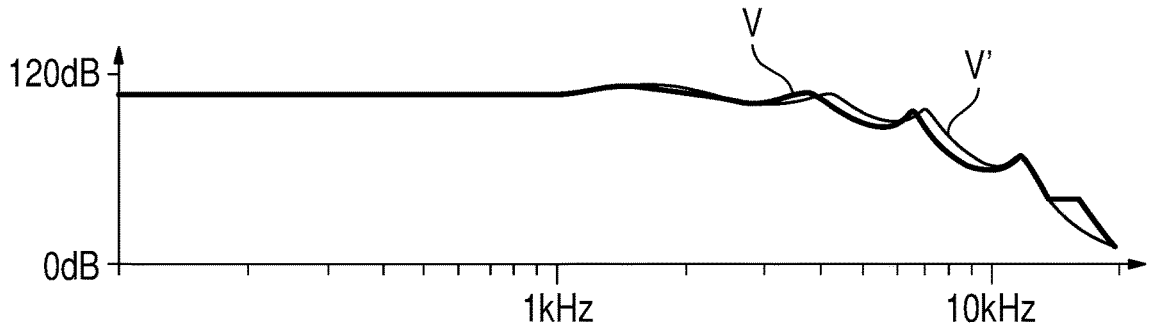
FIG. 3 is a graph illustrating different response behaviors of a receiver.

In FIG. 3, two response behaviors V, V' are shown by way of example. The respective response behavior V, V' is defined by the ratio of the powers of the audio signal A and the resulting sound signal S. The response behavior V, V' therefore indicates which output power the receiver 8 has for a given input power. The response behavior V, V' is frequency-dependent, i.e. audio signals A having equal strength but different frequencies may, depending on the circumstances, be converted into sound signals S of different strengths. In FIG. 3, the respective response behavior V, V' was determined by converting audio signals A having the same power but different frequencies by means of the receiver 8, and plotting the power of the respective resulting sound signal S on the Y axis with respect to the frequency on the X axis. The two graphs have been generated for different lengths of sound tubes 12. It is readily apparent that the length of the sound tube 12 changes the response behavior V, V'. In FIG. 3, this is particularly evident from the local maxima. As a result, the response behavior V' is changed relative to the response behavior V, and some of the local maxima are shifted significantly towards higher frequencies. If, for example, the response behavior V leads to a specific and desired output characteristic of the hearing device 2 as a whole, then it becomes clear that the changed response behavior V', given the same control of the receiver 8 by the control unit 6, must lead to a correspondingly changed output characteristic. Therefore, the desired response behavior V at the beginning, for example, in a fitting session, is established as a desired response behavior V' that is present during normal operation of the hearing device or is present in an additional fitting session. The difference in the response behaviors V, V' is then obtained, and the control of the receiver 8 is changed in such a way that the resulting response behavior V corresponds to the desired response behavior. A change is brought about, for example, by additional modification of the audio signals A via the control unit 6.

Figure 4:
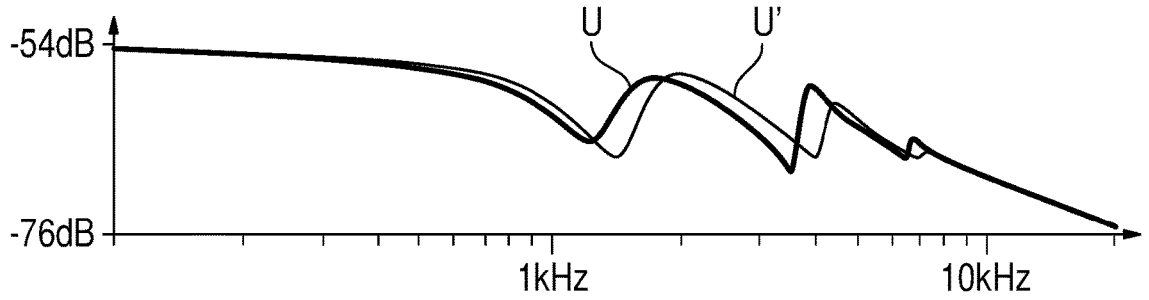
FIG. 4 is a graph showing magnetic field measurements for the response behaviors of FIG. 3.

FIG. 4 shows a simulation of the measurement signal U, U' for the respective magnetic field M of the two response behaviors V, V' from FIG. 3. In this case, the hearing device 2 has a telecoil, which is used as a magnetic field sensor 14, and FIG. 4 shows the measurement signals U, U', which are generated by the magnetic field sensor 14. The differences between the two measurement signals U, U' and their correlation to the response behaviors V, V' are readily apparent. In particular, the measurement signals U, U' each represent the first derivative of the respective response behavior V, V'.

Figure 5:
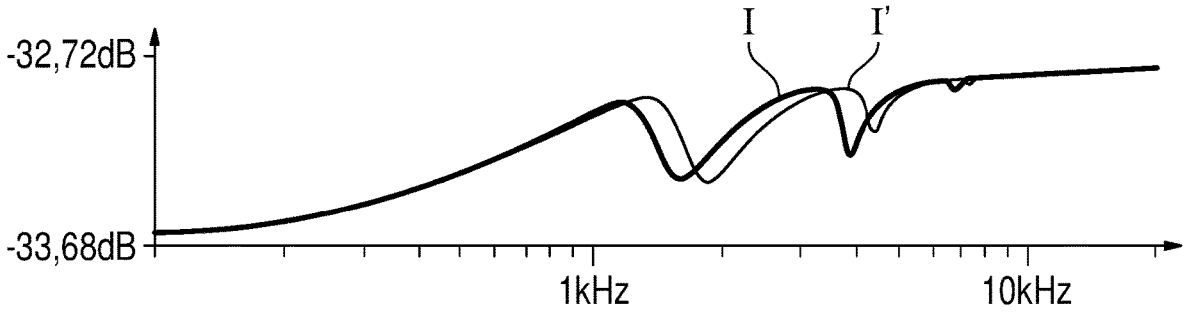
FIG. 5 is a graph showing impedance measurements for the response behaviors of FIG. 3.

For comparison, a simulation of impedance measurements I, I' for the two response behaviors V, V' from FIG. 3 is shown in FIG. 5. It is readily apparent that the signal strength, which is respectively plotted on the Y-axis, is significantly larger in FIG. 4. The dynamic of the measurement signals U, U' is therefore significantly greater than the dynamic of the impedance measurements I, I'. The magnetic field measurement thus leads to a significantly more accurate result, and even the smallest changes may still be reliably measured.

In an embodiment which is not shown, the response behavior V, V' is parameterized by means of an adaptive filter which is e.g. a component of the control unit 6. The magnetic field M is measured, and based on this, a measurement signal U, U' is generated, which is fed to the filter as a filter input signal. The filter has a filter function which is parameterized by a number of filter parameters. The measurement signal U, U' is then fed to the filter as a filter input signal, whereupon the filter automatically adapts the filter function to the filter input signal, in order to map this signal. The filter parameters are then changed accordingly. The filter adapts and modifies the filter parameters automatically. The filter parameters change when there is a change in the magnetic field M, and thus also when there is a change in the response behavior V, V', so that the response behavior V, V' is advantageously parameterized, and also determined, by means of the filter parameters. Thus, instead of measuring the response behavior V, V' in detail, only the filter parameters are used to determine the response behavior V, V'.

The following is a summary list of reference numerals and symbols used in the above description of the invention:

2 Hearing device
4 Microphone
6 Control unit
8 Receiver
10 Housing
12 Sound tube
14 Magnetic field sensor
16 Power supply line
18 Power supply
20 Test apparatus
A Audio signal
I, I' Impedance measurement
M Magnetic field
S Sound signal
U, U' Measurement signal
V, V' Response behavior

The invention claimed is:

1. A method for characterizing a receiver of a hearing device, wherein the receiver is embedded in an environment and exhibits a response behavior that is influenced by the environment, the method comprising:

converting with the receiver an electrical audio signal into a sound signal and thereby generating a magnetic field;

measuring the magnetic field with a magnetic field sensor; and characterizing the receiver by determining the response behavior of the receiver based on the magnetic field measured by the magnetic field sensor, the response behavior being a ratio between an input power and an output power of the receiver.

2. The method according to claim 1, wherein the environment is determined by an installation situation of the receiver and has an element which is a component of the hearing device, wherein the component is connected to the receiver and influences the response behavior.

3. The method according to claim 1, wherein the environment is determined by a usage situation of the receiver, the usage situation determining the response behavior of the receiver and being a usage situation selected from the group consisting of a wearing style of the hearing device, a degree of coupling between the receiver and an ear of the user, a degree of clogging of the user's ear canal by earwax.

4. The method according to claim 1, which comprises comparing an actual response behavior with a desired response behavior, determining a difference between the actual response behavior and the desired response behavior, and adjusting the hearing device based on the difference.

5. The method according to claim 4, which comprises adjusting the hearing device by modifying the audio signal with a control unit, such that a difference is at least partially compensated.

6. The method according to claim 1, which comprises comparing an actual response behavior with a desired response behavior, to determine a difference between the actual response behavior and the desired response behavior, and outputting a warning signal depending on the difference.

7. The method according to claim 1, which comprises parameterizing the response behavior with an adaptive filter by measuring the magnetic field, the adaptive filter having a filter function which is parameterized by a plurality of filter parameters, generating a measurement signal based on the measured magnetic field, and feeding the measurement signal to the adaptive filter as a filter input signal.

8. The method according to claim 1, wherein the magnetic field sensor is disposed in direct vicinity of receiver, and the magnetic field is measured directly at the receiver.

9. The method according to claim 8, wherein the magnetic field sensor is disposed at a distance of no more than 3 cm from the receiver.

10. The method according to claim 1, wherein the hearing device has a power supply and a power supply line connecting the receiver to the power supply for supplying power to the receiver, the magnetic field sensor is disposed in direct vicinity of the power supply line, and the method comprises measuring the magnetic field directly at the power supply line.

11. The method according to claim 10, wherein the magnetic field sensor is disposed at a distance of no more than 5 mm from the power supply line.

12. The method according to claim 1, which comprises using a telecoil of the hearing device as the magnetic field sensor.

13. A hearing device, comprising:

a receiver for converting an electrical audio signal into a sound signal, and thereby generating a magnetic field;

a magnetic field sensor;

a control unit connected to said receiver and to said magnetic field sensor, said control unit being configured:

to measure the magnetic field by way of said magnetic field sensor; and to characterize said receiver by determining a response behavior of the receiver based on the magnetic field measured by said magnetic field sensor, the response behavior being a ratio between an output power and an input power of the receiver.

14. A test arrangement for testing a hearing device, the hearing device having a receiver for converting an electrical audio signal into a sound signal and thereby generating a magnetic field, the test arrangement comprising:

a test apparatus having a magnetic field sensor;

a control unit configured:

to cause the magnetic field sensor to measure the magnetic field generated by the receiver; and to characterize the receiver by determining a response behavior of the receiver based on the magnetic field measured by the magnetic field sensor, the response behavior being a ratio between an output power and an input power of the receiver.

15. The test arrangement according to claim 14, wherein said test apparatus is a telecoil shoe to be placed on the hearing device as an adapter, and said magnetic field sensor is a telecoil arranged in said telecoil shoe.

16. The method according to claim 1, the input power is a power of the electrical audio signal and the output power is a power of the sound signal, and the response behavior is a ratio between the power of the electrical audio signal and the power of the sound signal.

17. The method according to claim 7, wherein the filter is a Wiener filter.

* * * * *